US007965306B2

(12) United States Patent
Onishi

(10) Patent No.: US 7,965,306 B2
(45) Date of Patent: Jun. 21, 2011

(54) THERMAL TRANSFER PRINTING METHOD

(75) Inventor: Jiro Onishi, Tokyo-To (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 106 days.

(21) Appl. No.: 12/407,200

(22) Filed: Mar. 19, 2009

(65) Prior Publication Data

US 2009/0244251 A1 Oct. 1, 2009

(30) Foreign Application Priority Data

Mar. 25, 2008 (JP) ..... 2008-078499
Mar. 25, 2008 (JP) ..... 2008-078535

(51) Int. Cl.
*B41J 2/325* (2006.01)

(52) U.S. Cl. ..... 347/176; 347/212

(58) Field of Classification Search ..... 347/172, 347/174, 176, 212; 400/120.01, 120.02, 400/120.04

See application file for complete search history.

(56) References Cited

U.S. PATENT DOCUMENTS 5,956,067 A 9/1999 Isono et al.
6,146,035 A * 11/2000 Ishigouoka et al. ..... 400/621
6,388,692 B1 5/2002 Iwata et al.
6,857,736 B2 * 2/2005 Onishi et al. ..... 347/105
2001/0019351 A1 9/2001 Fujishiro
2003/0174195 A1 9/2003 Onishi et al.
2007/0065209 A1 3/2007 Jang et al.

FOREIGN PATENT DOCUMENTS

JP 09-001941 1/1997
JP 2003-136770 5/2003
JP 3688433 6/2005

* cited by examiner

*Primary Examiner* — Huan H Tran
(74) *Attorney, Agent, or Firm* — Burr & Brown

(57) ABSTRACT

A thermal transfer printing method for forming a screen on photographic paper without providing a margin between the screen and a screen adjacent thereto. Photographic paper is unwound from a roll and then a screen having an image is formed on the paper, by transferring yellow, magenta, and cyan colorants onto the paper using a first heating means, without providing a margin between the screen and an adjacent screen. The paper is then cut at a rear edge of the screen so as to manufacture an individual photographic paper on which the screen has been formed, which is then conveyed to a second heating means. A screen protective layer is then formed on an overall surface of the screen formed on the individual photographic paper, by thermally transferring the screen protective film onto the overall surface of the screen formed on the individual photographic paper by the second heating means.

5 Claims, 8 Drawing Sheets

THERMAL TRANSFER PRINTING METHOD

FIELD OF THE INVENTION

The present invention relates to a thermal transfer printing method that forms a screen having an image on a photographic paper, by transferring a yellow colorant, a magenta colorant, and a cyan colorant, onto the photographic paper, by sublimation, and forms a screen protective layer on the screen.

BACKGROUND OF THE INVENTION

Generally when screens are formed on a photographic paper by a thermal transfer printing system the screens formed each having an image on a photographic paper, a yellow colorant (Y), a magenta colorant (M), and a cyan colorant (C) are sequentially transferred onto a photographic paper by sublimation, so as to form a screen having an image. As shown in FIG. 9, the screen 56 is formed larger than an individual photographic paper 54, which will be manufactured thereafter by cutting the a photographic paper 52. The screen 56 is provided with a margin cut portion 53 between the screen 56 and a forward screen 56 adjacent thereto, and another margin cut portion 53 between the screen 56 and a rearward screen 56 adjacent thereto. Then, a screen protective layer 55 having the same dimensions as those of the screen 56 is formed on the screen 56, and the photographic paper 52 is cut at a position on which a predetermined margin is left from a front edge 56*b* of the screen 56 formed on the photographic paper 52. Then, the photographic paper 52 is cut at a position on which a predetermined margin is left from a rear edge 56*a* of the screen 56. Thus, the individual photographic paper 54 is manufactured (see, for example, Patent Document 1). Thereafter, the margin cut portions 53, which are located between the screen 56 and the forward screen 56 adjacent thereto, and between the screen 56 and rearward screen 56 adjacent thereto, are cut down.

[Patent Document 1] P Patent Publication No. 3688433

When the individual photographic papers 54 are sequentially manufactured by such a thermal transfer printing system, a number of margin cut portions 53 are cut down and thrown out. Thus, there is a problem in that a great amount of waste matter is generated. In addition, when a number of margin cut portions 53 are cut down, there is a possibility that some of the cut-down margin cut portions 53 might clog up a mechanism part or the like of the thermal transfer printing system so that an operation of the thermal transfer printing system might be stopped.

Further, the front side and the rear side of each screen 56 are cut by a cutter, i.e., the cutter cuts the photographic paper 52 twice for each screen 56. Thus, there is another problem in that the cutter is likely to worn away relatively in a short period of time.

In order to solve these problems, there has been known a method for forming screens without providing a margin between the adjacent screens. When screens are formed on a photographic paper by this method, as shown in FIG. 10, formed on a photographic paper 62 at first is a screen 66 having the same dimensions as those of an individual photographic paper 64 that will be obtained thereafter by cutting the photographic paper 62. Then, a screen protective layer 65 is formed on the screen 66 with a predetermined margin left from a rear edge 66*a* of the screen 66. After that, the photographic paper 62 is cut at the rear edge 66*a* of the screen 66, so that an individual photographic paper 64 is manufactured. In consideration of a case in which a cut position of the photographic paper 62 is shifted from the rear edge 66*a* of the screen 66, the screen protective layer 66 is formed with a predetermined margin left from the rear edge 66*a* of the screen 66.

SUMMARY OF THE INVENTION

Problem to be Solved by the Invention

However, as described above, when the screen protective layer is formed with a predetermined margin left from the rear edge of the screen, the screen protective layer is not formed on the screen at a position near to the rear end of the individual photographic paper, whereby a part of the screen near to the rear edge is exposed to the outside. Since the exposed part of the screen does not have a light resistance, there is a possibility that a color of the image might be bleached out over time. In addition, when someone touches the exposed part of the screen by hand, and the colorants of Y, M, and C forming the screen adhere to the hand, there is a possibility that the image on the screen might be deteriorated. In this case, it is difficult to maintain the image quality of the screen.

As shown in FIG. 11, in such a thermal transfer printing system, there is used a unitary ribbon 70 having a yellow (Y) layer 71, a magenta (M) layer 72, a cyan (C) layer 73, and a screen protective film 74 (see, for example, Patent Documents 2 and 3). When a screen is formed on a photographic paper by using the unitary ribbon 70, the Y colorant, the M colorant, and the C colorant are sequentially transferred at first by a thermal head from the unitary ribbon onto a photographic paper by sublimation, so that a screen is formed. Then, the screen protective film is transferred from the unitary ribbon onto the screen, so that a screen protective layer is formed.

[Patent Document 2] JP9-1941A

[Patent Document 3] JP2003-136770A

In this case, the Y colorant, the M colorant, the C colorant, and the screen protective film are sequentially transferred onto the photographic paper by the single thermal head, which is described above. Thus, a relatively longer time is required for performing the thermal transfer printing method that forms the screen on the photographic paper and then forms the screen protective layer on the screen.

The present invention has been made in view of the above circumstances. The object of the present invention is to provide a thermal transfer printing method that is capable of forming screens on a photographic paper without providing a margin between the adjacent screens, and of maintaining an image quality of the screens.

Another object of the present invention is to provide a thermal transfer printing method that is capable of further reducing a time required for a thermal transfer printing method that forms a screen on a photographic paper and forms a screen protective layer on the screen.

Means for Solving the Problem

The present invention is a thermal transfer printing method comprising: a step in which a photographic paper is unwound from a photographic paper roll and the photographic paper is sent; a step in which, with the use of an ink ribbon having a yellow layer, a magenta layer, and a cyan layer, a screen having an image is formed on the photographic paper, by transferring a yellow colorant, a magenta colorant, and a cyan colorant onto the photographic paper by sublimation by means of a first heating means, without providing a margin between the screen and a screen adjacent thereto; a step in which, after the screen has been formed on the photographic paper, the photographic paper is cut by means of a cutting means at a rear edge of the screen so as to manufacture an individual photographic paper on which the screen has been formed, and the individual photographic paper is conveyed to a second heating means; and a step in which, with the use of a screen protective ribbon having a screen protective film, a screen protective layer is formed on an overall surface of the screen formed on the individual photographic paper, by thermally transferring the screen protective film onto the overall surface of the screen formed on the individual photographic paper by means of the second heating means.

The present invention is a thermal transfer printing method wherein, when the screen is formed on the photographic paper by the first heating means, the image of the screen formed on the photographic paper is gradually thinned from at least a part near to the rear edge of the screen toward at least the rear edge of the screen.

The present invention is a thermal transfer printing method wherein, when the screen is formed on the photographic paper by the first heating means, an amount of each of the Y colorant, the magenta colorant, and the cyan colorant is gradually decreased from at least a part near to the rear edge of the screen toward at least the rear edge of the screen, so as to gradually thin the image of the screen formed on the photographic paper.

The present invention is a thermal transfer printing method wherein, when the screen is formed on the photographic paper by the first heating means, an amount of energy for heating each of the yellow layer, the magenta layer, and the cyan layer, by the first heating means is gradually decreased from at least a part near to the rear edge of the screen toward at least the rear edge of the screen, so as to gradually thin the image of the screen formed on the photographic paper.

The present invention is a thermal transfer printing method comprising: a step in which a photographic paper is unwound from a photographic paper roll and the photographic paper is sent; a step in which, with the use of an ink ribbon having a yellow layer, a magenta layer, and a cyan layer, a plurality of screens each having an image are continuously formed on the photographic paper, by transferring a yellow colorant, a magenta colorant, and a cyan colorant onto the photographic paper by sublimation by means of a first heating means; a step in which, after the plurality of screens have been continuously formed on the photographic paper, the photographic paper is cut by means of a cutting means so as to manufacture individual photographic papers, and the individual photographic papers are conveyed to a second heating means; and a step in which, with the use of a screen protective ribbon having screen protective films, screen protective layers are formed on surfaces of the screens formed on the individual photographic papers, by thermally transferring the screen protective films onto the surfaces of the screens formed on the individual photographic papers by means of the second heating means.

The present invention is a thermal transfer printing method wherein the cutting means cuts the photographic paper at each screen, so as to form the individual photographic papers.

Effect of the Invention

According to the present invention, with the use of the ink ribbon having a yellow layer, a magenta layer, and a cyan layer, a screen having an image is formed on the photographic paper, by transferring a yellow colorant, a magenta colorant, and a cyan colorant onto the photographic paper by sublimation by the first heating means, without providing a margin between the screen and a screen adjacent thereto. Then, the photographic paper is cut by means of a cutting means at a rear edge of the screen so as to manufacture an individual photographic paper on which an image has been formed, and the individual photographic paper is conveyed to the second heating means. Thereafter, with the use of the screen protective ribbon having the screen protective film, the screen protective layer is formed on an overall surface of the screen formed on the individual photographic paper, by thermally transferring the screen protective film onto the overall surface of the screen formed on the individual photographic paper by means of the second heating means. Namely, after the individual photographic paper has been formed by cutting the photographic paper, the screen protective layer is formed on the overall surface of the screen formed on the individual screen paper. Thus, there is no possibility that a part of the screen formed on the photographic paper is exposed to the outside, whereby an image quality of the screen can be maintained.

In addition, according to the present invention, with the use of the ink ribbon having the yellow layer, the magenta layer, and the cyan layer, a plurality of screens each having an image are continuously formed on a photographic paper, by transferring a yellow colorant, a magenta colorant, and a cyan colorant onto the photographic paper by sublimation by the first heating means. Then, the photographic paper is cut by means of the cutting means so as to manufacture individual photographic papers, and the individual photographic papers are conveyed to the second heating means. Thereafter, with the use of the screen protective ribbon having a screen protective film, the screen protective layers are formed on surfaces of the screens formed on the individual photographic papers, by thermally transferring the screen protective films onto the surfaces of the screen formed on the individual photographic papers by means of the second heating means. Simultaneously therewith, a plurality of screens each having an image are continuously formed on the rearward photographic paper by transferring a yellow colorant, a magenta colorant, and a cyan colorant onto the photographic paper by sublimation by the first heating means. Namely, it is possible to simultaneously perform the sublimation transfer of the yellow colorant, the magenta colorant, and the cyan colorant by the first heating means, and the thermal transfer of the screen protective layers by the second heating means. Thus, a time required for the thermal transfer printing method that forms screens on a photographic paper and forms screen protective layers on the screens can be further reduced.

BRIEF DESCRIPTION OF THE DRAWINGS

FIG. 4(*b*) is a view showing a state in which an individual photographic paper is manufactured in the first embodiment of the thermal transfer printing method according to the present invention.

FIG. 4(*c*) is a view showing a state in which a screen protective layer is formed on an overall surface of the screen formed on the individual photographic paper in the first embodiment of the thermal transfer printing method according to the present invention.

FIG. 6(*b*) is a view showing a state in which two individual photographic papers are manufactured in the second embodiment of the thermal transfer printing method according to the present invention.

FIG. 6(*c*) is a view showing a state in which a screen protective layer is formed on an overall surface of the screen formed on each of the individual photographic papers in the second embodiment of the thermal transfer printing method according to the present invention.

FIG. 8(*b*) is a view showing a state in which a multiple screen photographic paper composed of the two screens each having an image is manufactured in the third embodiment of the thermal transfer printing method according to the present invention.

FIG. 8(*c*) is a view showing a state in which a screen protective layer is formed on overall surfaces of the screens formed on the multiple screen photographic paper in the third embodiment of the thermal transfer printing method according to the present invention.

FIG. 8(*d*) is a view showing a state in which individual photographic papers are formed in the third embodiment of the thermal transfer printing method according to the present invention.

DETAILED DESCRIPTION OF THE INVENTION

First Embodiment

Embodiments of the present invention will be described below with reference to the drawings. FIGS. 1 to 4 are views showing a first embodiment of a thermal transfer printing method according to the present invention.

Figure 1:
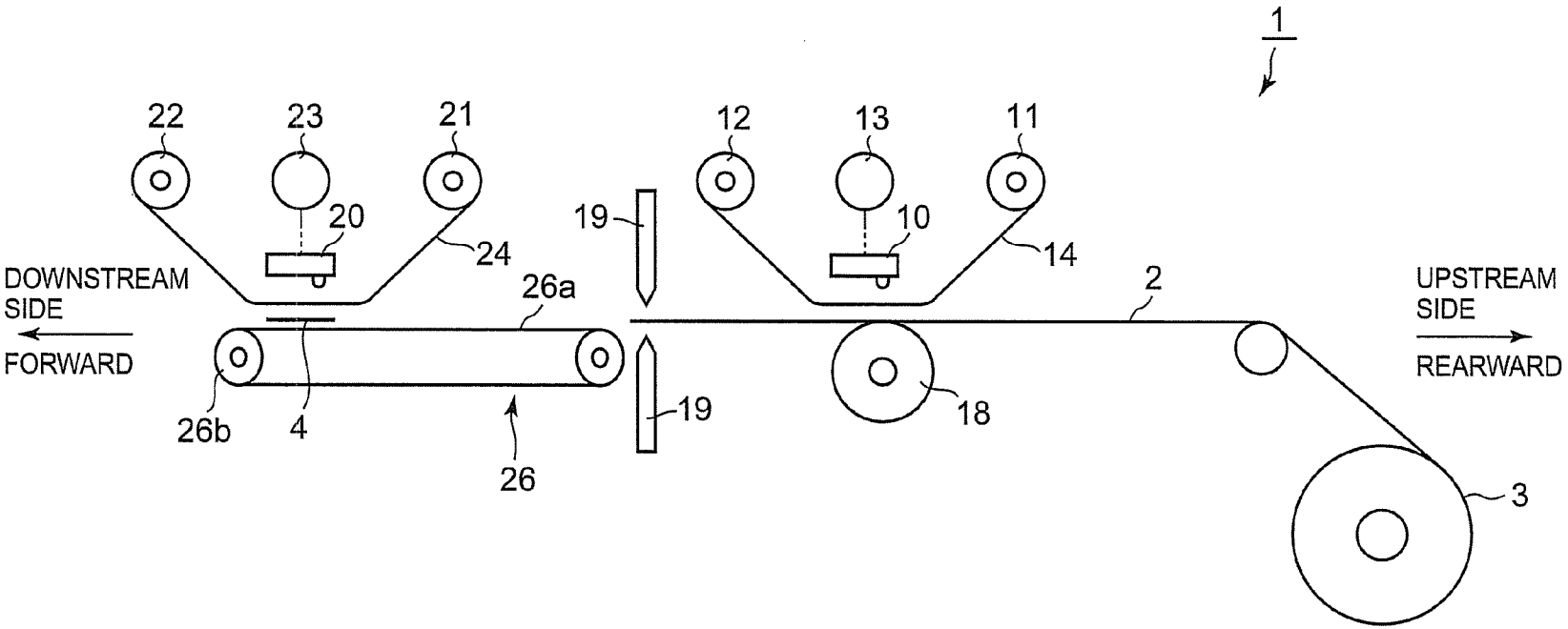
FIG. 1 is a schematic view showing a whole structure of a thermal transfer printing system by a first embodiment of a thermal transfer printing method according to the present invention.

Referring to FIG. 1, a whole structure of a thermal transfer printing system is described. The thermal transfer printing system forms a screen having an image on a photographic paper, by transferring a yellow colorant, a magenta colorant, and a cyan colorant, onto the printing paper by sublimation, and forms a screen protective layer on the screen.

Figure 2:
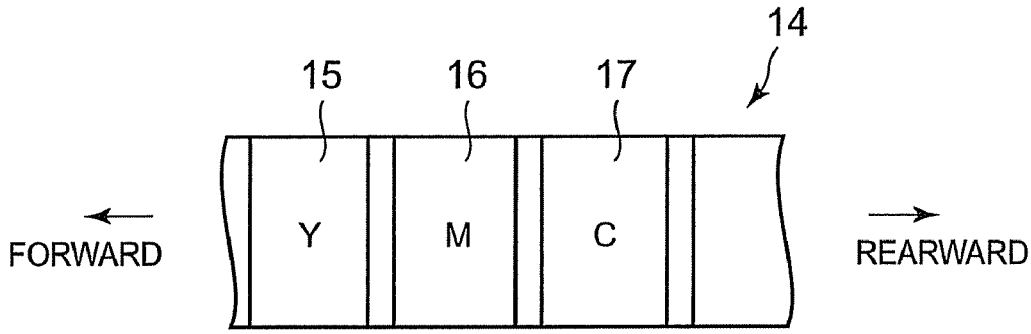
FIG. 2 is a top view of an ink ribbon used in the first embodiment of the thermal transfer printing method according to the present invention.

As shown in FIG. 1, the thermal transfer printing system 1 includes a photographic paper roll 3 wound with a photographic paper 2, and a first thermal head (first heating means) 10 disposed on a downstream side of the photographic paper roll 3, the first thermal head 10 being configured to form a screen 6 having an image on the photographic paper 2 by transferring a yellow colorant, a magenta colorant, and a cyan colorant, onto the photographic paper 2 by sublimation, with the use of an ink ribbon 14 (see, FIG. 2) having a yellow (Y) layer 15, a magenta (M) layer 16, and a cyan (C) layer 17. As shown in FIG. 2, the yellow (Y) layer 15, the magenta (M) layer 16, and the cyan (C) layer 17 are formed in this order on one surface of the ink ribbon 14. An ink-ribbon supply roll 11 formed by winding the ink ribbon 14 is disposed on an upstream side of the first thermal head 10, and an ink-ribbon withdrawal roll 12 is disposed on a downstream side of the first thermal head 10. Thus, the ink ribbon 14 unwound from the ink-ribbon supply roll 11 is withdrawn by the ink-ribbon withdrawal roll 12 through the first thermal head 10.

As shown in FIG. 1, a platen roll 18, which can be driven in rotation, is disposed below the first thermal head 10. Connected to the first thermal head 10 is a first elevating means 13 configured to move the first thermal head 10 toward and apart from the platen roll 18 in an up and down direction.

Disposed on the downstream side of the first thermal head 10 is a cutting means 19 configured to cut the photographic paper 2 on which a screen 6 has been formed by the first thermal head 10. The cutting means 19 cuts the photographic paper 2 on which the screen 6 has been formed at a rear edge 6*a* (see, FIG. 4(*a*)) of the screen 6, so as to manufacture an individual photographic paper 4 (see, FIG. 4(*b*)) on which the screen 6 has been formed. A distance between the first thermal head 10 and the cutting means 19 is preferably 50 mm or less, and more preferably 20 mm or less.

Figure 3:
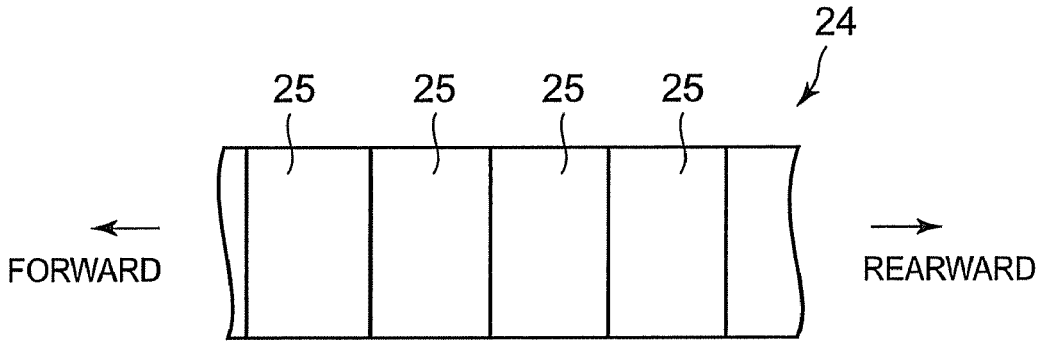
FIG. 3 is a top view of a screen protective ribbon used in the first embodiment of the thermal transfer printing method according to the present invention.

A second thermal head (second heating means) 20 is disposed on the downstream side of the cutting means 19. With the use of a screen protective ribbon 24 having screen protective films 25 (see, FIG. 3), the second thermal head 20 is configured to form a screen protective layer 5 by thermally transferring the screen protective film 25 onto an overall surface of the screen 6 formed on the individual photographic paper 4. As shown in FIG. 3, the plurality of screen protective films 25 are formed on one surface of the screen protective ribbon 24. A screen-protective-ribbon supply roll 21 wound with the screen protective ribbon 24 is disposed on the upstream side of the second thermal head 20, and a screen-protective-ribbon withdrawal roll 22 is disposed on the downstream side of the second thermal head 20. Thus, the screen protective ribbon 24 unwound from the screen-protective-ribbon supply roll 21 is withdrawn by the screen-protective-ribbon withdrawal roll 22 through the second thermal head 20.

Between the cutting means 19 and the second thermal head 20, there is disposed a conveying means 26 configured to convey the individual photographic paper 4 formed by the cutting means 19 to the second thermal head 20. The conveying means 26 has a conveyor 26*a* on which the individual photographic paper 4 can be placed, and a driving part 26*b* configured to drive the conveyer 26*a*.

Connected to the second thermal head 20 is a second elevating means 23 configured to move the second thermal head 20 toward and apart from the conveyor 26*a* of the conveying means 26 in the up and down direction.

Next, materials of the respective constituent elements are described. As a material used for the Y layer 15, the M layer 16, and the C layer 17 of the ink ribbon 14, it is preferable to use a material (colorant) including a binder resin and a sublimation dye melted or dispersed in the binder resin.

As a material used for the screen protective film 25 of the screen protective ribbon 24, it is preferable to use a transparent material having an adhesiveness, a light resistance, and so on.

Next, an operation of this embodiment as structured above, i.e., a thermal transfer printing method according to the present invention is described.

As shown in FIG. 1, the photographic paper 2 is firstly unwound from the photographic paper roll 3, and the photographic paper 2 is sent to the first thermal head 10. During this operation, the ink ribbon 14 wound on the ink-ribbon supply roll 11 is unwound therefrom, and the ink ribbon 14 is sent to the first thermal head 10.

Figure 4:
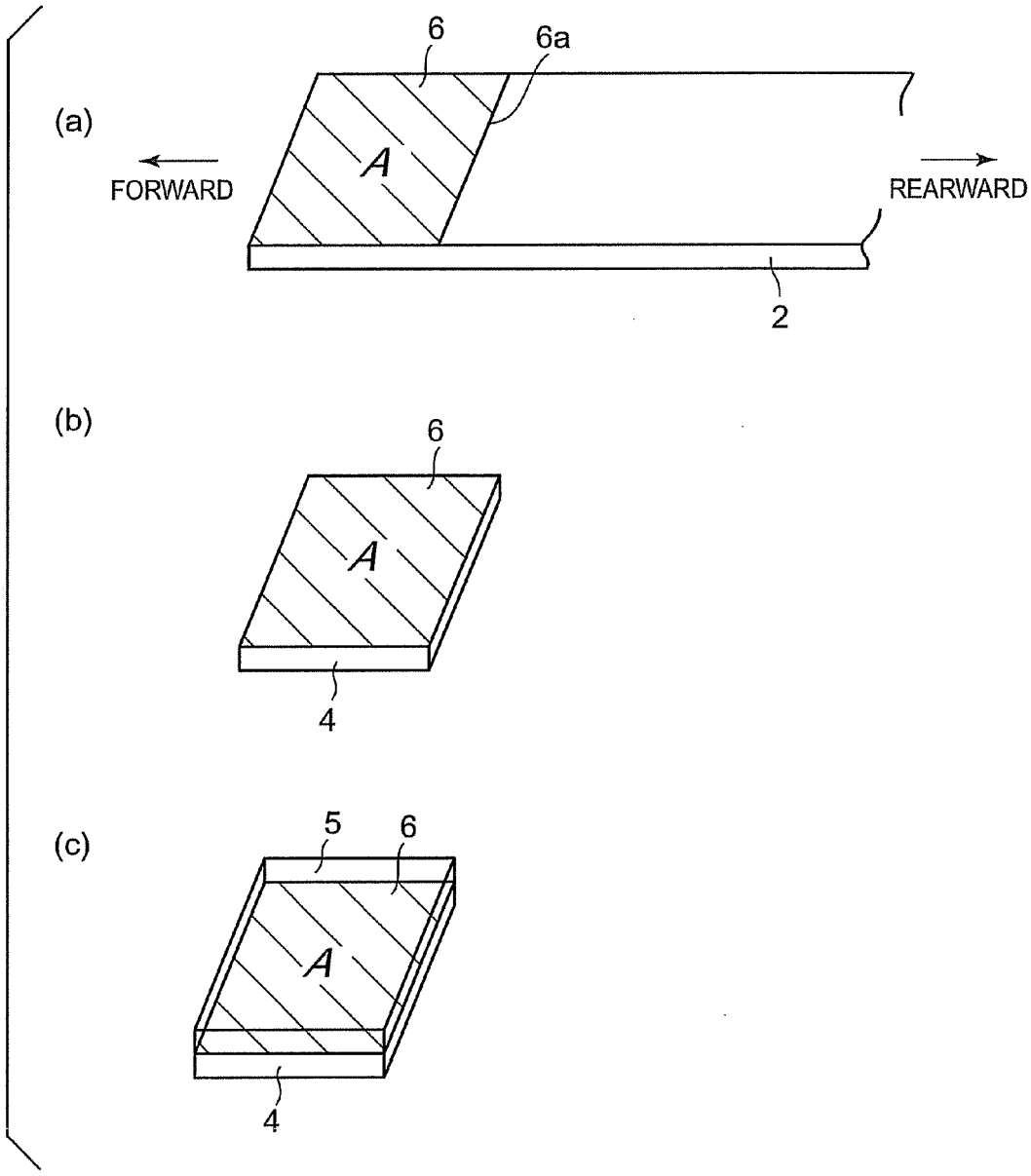
FIG. 4(*a*) is a view showing a state in which a screen having an image is formed on a photographic paper in the first embodiment of the thermal transfer printing method according to the present invention.

Then, as shown in FIG. 4(*a*), with the use of the ink ribbon 14, a screen 6 having an image is formed by sequentially transferring a yellow colorant, a magenta colorant, and a cyan colorant onto the photographic paper 2 by sublimation by means of the first thermal head 10, without providing a margin between the screen 6 and a screen adjacent thereto. In this case, the photographic paper 2 and the Y layer 15 (see, FIG. 2) of the ink ribbon 14 are arranged in position in the first place. Then, the first thermal head 10 is moved downward toward the platen roll 18 by the first elevating means 13 connected to the first thermal head 10, so that the first thermal head 10 is brought into contact with the platen roll 18 through the photographic paper 2 and the ink ribbon 14.

Then, the platen roll 18 is driven in rotation, so that the photographic paper 2 and the ink ribbon 14 are sent forward. During this operation, based on image data having been sent to the first thermal head 10, an area of the Y layer 15 of the ink ribbon 14 is selectively heated by the first thermal head 10, so that the Y colorant is transferred from the ink ribbon 14 onto the photographic paper 2 by sublimation.

At this time, an amount of the Y colorant to be transferred onto the photographic paper 2 by sublimation is gradually decreased from a part near to the rear edge 6*a* of the screen 6 toward the rear edge 6*a* of the screen 6. Namely, the screen 6 is formed on the photographic paper 2 such that the image is gradually thinned from a part near to the rear edge 6*a* of the screen 6 toward the rear edge 6*a* of the screen 6. An area in which the colorant is gradually decreased is preferably in a range of 0.5 mm or less from the rear edge 6*a* over all the width of the photographic paper 2. In this case, a range in which the image is thinned from a part near to the rear edge 6*a* of the screen 6 is minimally restrained. In addition, even when a part of the image of the screen 6 overlaps with an image of a rearward screen 6 adjacent thereto, the part of the image of the screen 6 is prevented from appearing on the rearward screen 6.

In this manner, the Y colorant is transferred by sublimation onto the photographic paper 2 in an area corresponding to the screen 6 having an image, in compliance with the image data. At this time, the photographic paper 2 is sent forward by a distance corresponding to a screen 6 to be formed thereafter on the photographic paper 2, and the ink ribbon 14 is sent forward (to the side of the ink-ribbon withdrawal roll 12) by a distance corresponding to the screen 6.

Then, the first thermal head 10 is moved upward by the first elevating means 13 so as to be away from the platen roll 18.

Then, the M layer 16 and the photographic paper 2 are arranged in position. In this case, the photographic paper 2 is sent rearward by a distance corresponding to the screen 6, and the ink ribbon 14 is sent forward by a distance corresponding to a margin between the Y layer 15 and the M layer 16.

Then, similarly to the method for transferring the Y colorant by sublimation, the M colorant and the C colorant are sequentially transferred onto the photographic paper 2 by sublimation, so that a screen 6 having an image is formed on the photographic paper 2 (see, FIG. 4(*a*)).

Then, as shown in FIG. 4(*b*), the photographic paper 2 is cut by the cutting means 19 at a rear end 6*a* of the screen 6, so that an individual photographic paper 4 on which the screen 6 has been formed is manufactured.

As described above, the distance between the first thermal head 10 and the cutting means 19 is 50 mm or less, preferably 20 mm or less. Namely, the cutting means 19 is positioned relatively nearer to the first thermal head 10. Thus, the photographic paper 2, which is precisely positioned with respect to the first thermal head 10, is sent to the cutting means 19 while the precise positioning is being maintained. Therefore, the photographic paper 2 can be precisely cut by the cutting means 19 at the rear edge 6*a* of the screen 6 on the photographic paper 2.

Then, as shown in FIG. 1, the individual photographic paper 4 is placed on the conveyor 26*a* of the conveying means 26. Thereafter, the conveyor 26*a* is driven by the driving part 26*b* of the conveying means 26, so that the individual photographic paper 4 is conveyed to a position below the second thermal head 20. During this operation, the screen protective ribbon 24 wound on the screen-protective-ribbon supply roll 21 is unwound therefrom, and the screen protective ribbon 24 is sent to the second thermal head 20.

Then, as shown in FIG. 4(*c*), with the use of the screen protective ribbon 24, a screen protective layer 5 is formed on an overall surface of the screen 6 formed on the individual photographic paper 4, by thermally transferring the screen protective film 25 onto the overall surface of the screen 6 formed on the individual photographic paper 4 by means of the second thermal head 20. In this case, the individual photographic paper 4 and the screen protective film 25 of the screen protective ribbon 24 are arranged in position in the first place. Then, as shown in FIG. 1, the second thermal head 20 is moved downward toward the conveyor 26*a* of the conveying means 26 by the second elevating means 23 connected to the second thermal head 20, so that the second thermal head 20 is brought into contact with the conveyor 26*a* of the conveying means 26 through the individual photographic paper 4 and the screen protective ribbon 24.

Then, the conveyor 26*a* is driven by the driving part 26*b* of the conveying means 26, so that the individual photographic paper 4 and the screen protective ribbon 24 on the conveyor 26*a* are sent forward. During this operation, the screen protective ribbon 24 is heated by the second thermal head 20, so that the screen protective film 25 is thermally transferred from the screen protective ribbon 24 onto an overall surface of the screen 6 formed on the individual photographic paper 4. At this time, the individual photographic paper 4 is sent forward by a distance corresponding to the screen 6 formed on the individual photographic paper 4, and the screen protective ribbon 24 is sent forward (to the side of the screen-protective-ribbon withdrawal roll 22) by a distance corresponding to the screen 6.

Then, the second thermal head 20 is moved upward by the second elevating means 23 so as to be away from the conveyor 26*a* of the conveying means 26. In this manner, the screen protective layer 5 is formed on the overall surface of the screen 6 formed on the individual photographic paper 4 (see, FIG. 4(*c*)).

According to this embodiment, with the use of the ink ribbon 14 having the yellow layer 15, the magenta layer 16, and the cyan layer 17, the screen 6 having an image is formed at first on the photographic paper 2, by transferring the Y colorant, the M colorant, and the C colorant onto the photographic paper 2 by sublimation by means of the first thermal head 10, without providing a margin between the screen 6 and a screen adjacent thereto. Then, the photographic paper 2 is cut by means of the cutting means 19 at the rear edge 6*a* of the screen 6 so as to manufacture the individual photographic paper 4 on which the screen 6 has been formed. The individual photographic paper 4 is then conveyed by the conveying means 26 toward the second thermal head 20. Thereafter, with the use of the screen protective ribbon 24 having the screen protective film 25, the screen protective layer 5 is formed on the overall surface of the screen 6 formed on the individual photographic paper 4, by thermally transferring the screen protective film 25 onto the overall surface of the screen 6 formed on the individual photographic paper 4 by means of the second thermal head 20. Namely, after the individual photographic paper 4 has been formed by cutting the photographic paper 2, the screen protective layer 5 is formed on the overall surface of the screen 6 formed on the individual photographic paper 4.

Suppose that, after the screen protective layer 5 has been formed on the overall surface of the screen 6 formed on the photographic paper 2, the photographic paper 2 is cut so as to manufacture the individual photographic paper 4. In this case, if a position to be cut of the photographic paper 2 is shifted forward from the rear edge 6*a* of the screen 6, a part of the screen protective layer 5 remains on the rearward photographic paper 2. Under this state, it is difficult to form a rearward screen 6 adjacent to the screen 6 on the photographic paper 2.

On the other hand, according to the present invention, the individual photographic paper 4 is firstly formed by cutting the photographic paper 2. Following thereto, the screen protective layer 5 is formed on the overall surface of the screen 6 formed on the individual photographic paper 4. Thus, there is no possibility that a part of the screen protective layer 5 remains on the rearward photographic paper 2. Thus, instead of forming the screen protective layer 5 with a predetermined margin that is left from the rear edge 6*a* of the screen 6, the screen protective layer 5 can be formed on the overall surface of the screen 6 on the individual photographic layer 4. As a result, there is no possibility that a part of the screen 6 might be exposed to the outside, whereby the light resistance of the screen 6 can be reliably retained, which results in maintaining an image quality of the screen 6.

In addition, according to this embodiment, as described above, no margin is provided between the screen 6 and a screen adjacent thereto on the photographic paper 2. Namely, it is not necessary to provide a margin cut portion (see, FIG. 5) between the screen 6 and a forward screen 6 adjacent thereto and a margin cut portion between the screen 6 and a rearward screen 6 adjacent thereto, and to throw out such margin cut portions. Thus, the individual photographic papers 4 can be manufactured from the photographic paper 2 without any waste. Further, since there is no margin cut portion that is cut down from the photographic paper 2, it is possible to prevent generation of trouble which might be caused by the cut-down margin cut portion clogging up a mechanism part or the like of the thermal transfer printing system.

In addition, according to this embodiment, since no margin is provided between the adjacent screens 6 on the photographic paper 2, the individual photographic paper 4 can be manufactured by cutting only once the photographic paper 2 by the cutting means 19 at the rear edge 6*a* of the screen 6. Thus, when the cutting means 19 is formed of a cutter, the abrasion occurring to the cutter can be restrained, whereby a life duration of the cutter can be elongated.

Further, according to this embodiment, as described above, when the screen 6 is formed by transferring the Y colorant, the M colorant, and the C colorant by sublimation, the photographic paper 2 is moved forward and rearward in order for the sublimation transfer of the Y colorant, the M colorant, and the C colorant. On the other hand, when the screen protective layer 5 is formed on the overall surface of the screen 6, the individual photographic paper 4 is not moved rearward. Suppose that the photographic paper 2 on which the screen 6 has been formed by the first thermal head 10 is sent to the second thermal head 20, without cutting the photographic paper 2, so as to form the screen protective layer 5. In this case, because of the difference in movement of the photographic paper 2 relative to the respective thermal heads, there is a possibility that the photographic paper 2 might be distorted and/or strained between the first thermal head 10 and the second thermal head 20, resulting in deterioration of a quality of the screen 6 formed on the photographic paper 2.

On the other hand, according to this embodiment, after the screen 6 has been formed on the photographic paper 2 by the first thermal head 10, the individual photographic paper 4 is manufactured by cutting the photographic paper 2 by the cutting means 19, and then the individual photographic paper 4 is sent to the second thermal head 20. Thus, there is no possibility that the photographic paper 2 is distorted and/or strained between the first thermal head 10 and the second thermal head 20. Therefore, a quality of the screen 6 formed on the photographic paper 2 can be reliably retained.

In this embodiment, a thermal head is used as the second heating means. However, not limited to the thermal head, a line heater, a heating roll, and so on may be used.

In addition, in this embodiment, when the screen 6 is formed on the photographic paper 2 by the first thermal head 10, the image of the screen 6 formed on the photographic paper 2 is gradually thinned from a part near to the rear edge 6*a* of the screen toward the rear edge 6*a* of the screen 6. However, not limited to the rear edge 6*a* of the screen 6, the image of the screen 6 formed on the photographic paper 2 may be gradually thinned from parts near to peripheral edges of the screen 6 toward the respective peripheral edges of the screen 6.

Alternative Example of the Present Invention

Next, an alternative example of the thermal transfer printing method of the present invention will be described. In this alternative example, instead of gradually decreasing the amount of each of the Y colorant, the M colorant, and the C colorant, toward the rear edge of the screen, an amount of energy for heating each of the Y layer, the M layer, and the C layer by the first thermal head is gradually decreased to the rear edge of the screen. Other structures are substantially the same as those of the first embodiment shown in FIGS. 1 to 4.

According to this alternative example, as shown in FIGS. 1 and 4, when a screen 6 is formed on the photographic paper 2 by the first heating means 10, an amount of energy for heating each of the Y layer 15 (see, FIG. 2), the M layer 16, and the C layer 17 are gradually decreased from a part near to the rear edge 6*a* of the screen 6 toward the rear edge 6*a* of the screen 6, based on the image data. The respective Y colorant, the M colorant, and the C colorant are transferred onto the photographic paper 2 by sublimation in accordance with an amount of heating energy supplied from the first thermal head 10. Thus, areas of the Y layer 15, the M layer 16, and the C layer 17 of the ink ribbon 14 are selectively, sequentially heated by the first thermal head 10 based on the image data. Meanwhile, the screen 6 is formed on the photographic paper 2 such that the image is gradually thinned from a part near the rear edge 6*a* of the screen 6 toward the rear edge 6*a* of the screen 6. An area in which the amount of heating energy supplied from the first thermal head 10 is gradually decreased is preferably in a range of 0.5 mm or less from the rear edge 6*a* over all the width of the photographic paper 2. In this case, a range in which the image is thinned from a part near to the rear edge 6*a* is minimally restrained. In addition, even when a part of the image of the screen 6 overlaps with an image of a rearward screen 6 adjacent thereto, the part of the image of the screen 6 is prevented from appearing on the rearward screen 6.

Second Embodiment

Next, a second embodiment of the thermal transfer printing method according to the present invention will be described with reference to FIGS. 5 and 6.

Figure 5:
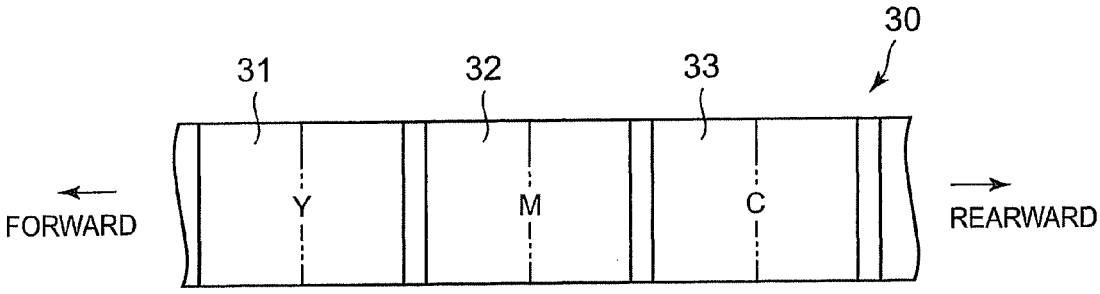
FIG. 5 is a top view of an ink ribbon used in a second embodiment of the thermal transfer printing method according to the present invention.
Figure 6:
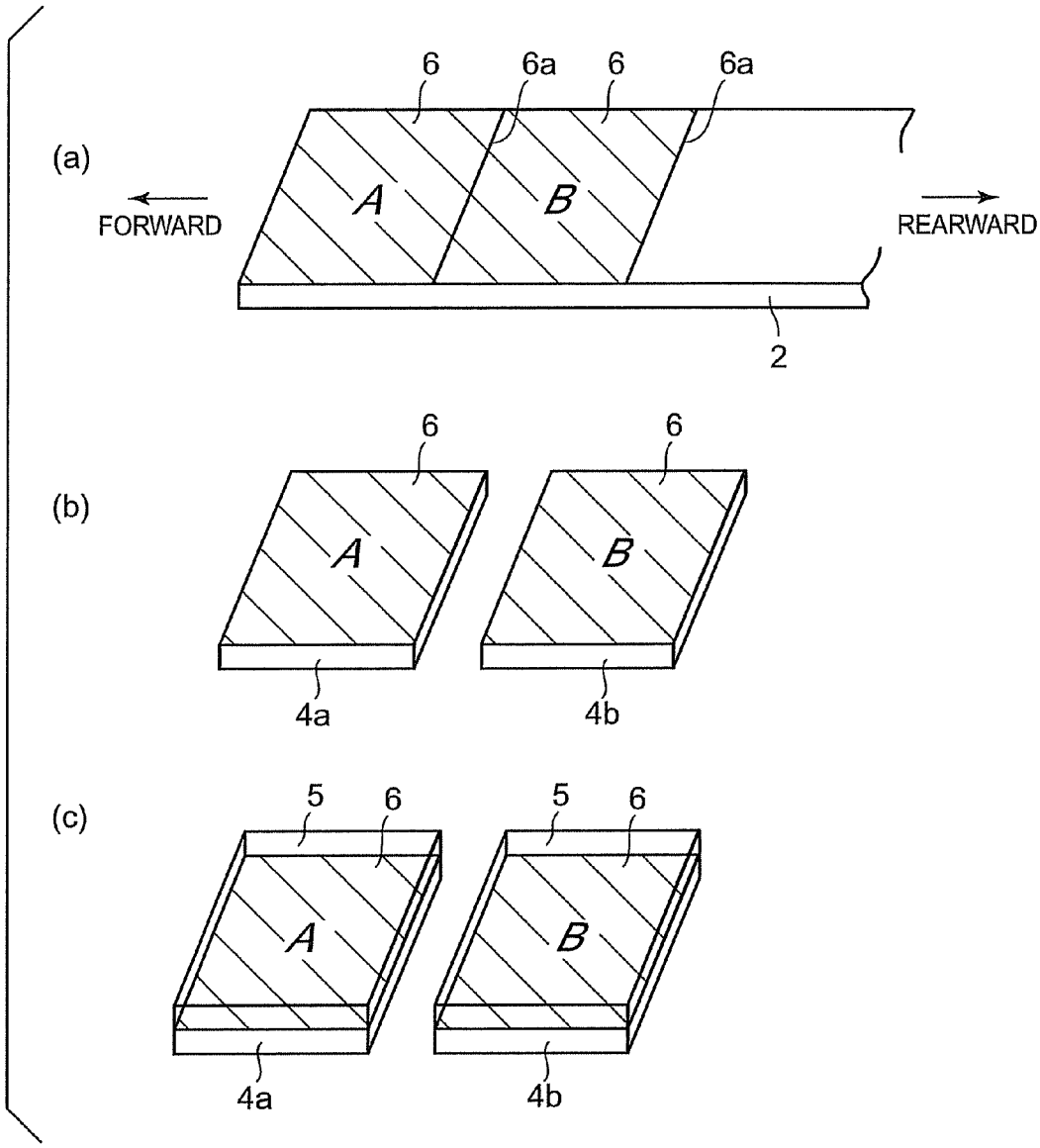
FIG. 6(*a*) is a view showing a state in which two screens each having an image are formed on a photographic paper in the second embodiment of the thermal transfer printing method according to the present invention.

The second embodiment of the thermal transfer printing method shown in FIGS. 5 and 6 differs from the first embodiment shown in FIGS. 1 to 4 only in that two screens each having an image are continuously formed on a photographic paper. Other structures of the second embodiment are substantially the same as those of the first embodiment. In FIGS. 5 and 6, the same elements as those in the first embodiment shown in FIGS. 1 to 4 are shown by the same reference numbers, and detailed description thereof is omitted.

In this embodiment, when screens each having an image are formed on a photographic paper 2, and a screen protective layer is formed on each screen, as shown in FIG. 1, the photographic paper 2 is firstly unwound from a photographic paper roll 3, and the photographic paper 2 is sent to a first thermal head 10. During this operation, an ink ribbon 30 wound on an ink-ribbon supply roll 11 is unwound therefrom, and the ink ribbon 30 is sent to the first thermal head 10.

Then, as shown in FIG. 6(*a*), with the use of the ink ribbon 30, two screens 6 each having an image are continuously formed on the photographic paper 2, by sequentially transferring a Y colorant, a M colorant, and a C colorant onto the photographic paper 2 by sublimation by means of the first thermal head 10, without providing a margin between the adjacent screens 6. In this case, the photographic paper 2 and a Y layer 31 of the ink ribbon 30 (see, FIG. 5) are arranged in position in the first place. Then, the first thermal head 10 is moved downward toward a platen roll 18 by a first elevating means 13 connected to the first thermal head 10, so that the first thermal head 10 is brought into contact with the platen roll 18 through the photographic paper 2 and the ink ribbon 30.

As shown in FIG. 5, the Y layer 31, the M layer 32, and the C layer 33 are formed in this order on one surface of the ink ribbon 30. The respective Y layer 31, the M layer 32, and the C layer 33 have dimensions corresponding to those of the two screens 6 each having an image.

Then, the platen roll 18 is driven in rotation, so that the photographic paper 2 and the ink ribbon 3 are sent forward. During this operation, based on image data having been sent to the first thermal head 10, an area of the Y layer 31 of the ink ribbon 30 is selectively heated by the first thermal head 10, so that the Y colorant is transferred from the ink ribbon 30 onto the photographic paper 2 by sublimation.

When the Y colorant is transferred onto the photographic paper 2 by sublimation, an amount the Y colorant to be transferred onto the photographic paper 2 by sublimation is gradually decreased from a part near to a rear edge 6*a* of each of the screens 6 toward the rear edge 6*a* of each of the screens 6. Thus, each of the screens 6 is formed on the photographic paper 2 such that the image is gradually thinned from a part near to the rear edge 6*a* of the screen 6 toward the rear edge 6*a* of the screen 6. An area in which the colorant is gradually decreased is preferably in a range of 0.5 mm or less from the rear edge 6*a* over all the width of the photographic paper 2. In this case, a range in which the image is thinned from a part near to the rear edge 6*a* of the screen 6 is minimally restrained. In addition, even when a part of the image of the screen 6 overlaps with the image of the rearward screen 6 adjacent thereto, the part of the image of the screen 6 is prevented from appearing on the rearward screen 6.

In this manner, the Y colorant is transferred by sublimation onto the photographic paper 2 in an area corresponding to the two screens 6 each having an image, in compliance with the image data. At this time, the photographic paper 2 is sent forward by a distance corresponding to two screens 6 to be formed thereafter on the photographic paper 2, and the ink ribbon 30 is moved forward (to the side of an ink-ribbon withdrawal roll 12) by a distance corresponding to the two screens 6.

Then, the photographic paper 2 and the M layer 32 of the ink ribbon 30 are arranged in position. At this time, the photographic paper 2 is moved rearward by a distance corresponding to the two screens 6, and the ink ribbon 30 are moved forward by a distance corresponding to a margin between the Y layer 31 and the M layer 32.

Then, similarly to the method for transferring the Y colorant by sublimation, the M colorant and the C colorant are sequentially transferred onto the photographic paper 2 by sublimation, so that two screens 6 each having an image are continuously formed on the photographic paper 2 (see, FIG. 6(*a*)).

Then, as shown in FIG. 6(*b*), the photographic paper 2 is cut by a cutting means 19 at a rear edge 6*a* of each of the screens 6, so that two individual photographic papers 4 (a first individual photographic paper 4*a* and a second individual photographic paper 4*b*) each having the one screen 6 are manufactured.

As described above, the distance between the first thermal head 10 and the cutting means 19 is 50 mm or less, preferably 20 mm or less. Namely, the cutting means 19 is positioned relatively nearer to the first thermal head 10. Thus, the photographic paper 2, which is precisely positioned with respect to the first thermal head 10, is sent to the cutting means 19 while the precise positioning is being maintained. Therefore, the photographic paper 2 can be precisely cut by the cutting means 19 at the rear edge 6*a* of each of the screens 6 on the photographic paper 2.

Then, as shown in FIG. 1, the first individual photographic paper 4*a* and the second photographic paper 4*b* (see, FIG. 6(*b*)) are sequentially placed on a conveyor 26*a* of a conveying means 26. Thereafter, the conveyor 26*a* is driven by a driving part 26*b* of the conveying means 26, so that the first individual photographic paper 4*a* and the second individual photographic paper 4*b* are sequentially conveyed to a position below a second thermal head 20. During this operation, a screen protective ribbon 24 wound on a screen-protective-ribbon supply roll 21 (see, FIG. 3) is unwound therefrom, and the screen protective ribbon 24 is sent to the second thermal head 20.

Then, as shown in FIG. 6(*c*), with the use of the screen protective ribbon 24, a screen protective layer 5 is formed on an overall surface of the screen 6 of the first individual photographic paper 4*a*, by thermally transferring a screen protective film 25 onto the overall surface of the screen 6 of the first individual photographic paper 4*a* by means of the second thermal head 20. In this case, the first individual photographic paper 4*a* and the screen protective film 25 of the screen protective ribbon 24 are arranged in position in the first place. Then, as shown in FIG. 1, the second thermal head 20 is moved downward toward the conveyor 26*a* of the conveying means 26 by a second elevating means 23 connected to the second thermal head 20, so that the second thermal head 20 is brought into contact with contact with the conveyor 26*a* of the conveying means 26 through the first individual photographic paper 4*a* and the screen protective ribbon 24.

Then, the conveyor 26*a* is driven by the driving part 26*b* of the conveying means 26, so that the first individual photographic paper 4*a* and the screen protective ribbon 24 on the conveyor 26*a* are sent forward. During this operation, the screen protective ribbon 24 is heated by the second thermal head 20, so that the screen protective film 25 is thermally transferred from the screen protective ribbon 24 onto an overall surface of the screen 6 formed on the first individual photographic paper 4*a*. At this time, the first individual photographic paper 4*a* is sent forward by a distance corresponding to the one screen 6 formed on the first individual photographic paper 4*a*, and the screen protective ribbon 24 is sent forward (to the side of the screen-protective-ribbon withdrawal roll 22) by a distance corresponding to the one screen 6.

Then, the second thermal head 20 is moved upward by the second elevating means 23 so as to be away from the conveyor 26*a* of the conveying means 26. In this manner, the screen protective layer 5 is formed on the overall surface of the screen 6 formed on the first individual photographic paper 4*a* (see, FIG. 6(*c*)).

Then, the second individual photographic paper 4*b* and a rearward screen protective film 25 of the screen protective ribbon 24 are arranged in position. Thereafter, similar to the method for forming the screen protective layer 5 on the overall surface of the screen 6 on the first individual photographic paper 4*a*, a screen protective layer 5 is formed on an overall surface of the screen 6 on the second individual photographic paper 4*b*.

According to this embodiment, after the individual photographic papers 4*a* and 4*b* have been formed by cutting the photographic paper 2, the screen protective layers 5 are respectively formed on the overall surfaces of the screens 6 formed on the individual photographic papers 4*a* and 4*b*. Suppose that, after the screen protective layer 5 has been formed on the overall surface of each the screens 6 formed on the photographic paper 2, the individual photographic papers 4*a* and 4*b* are manufactured by cutting the photographic paper 2. In this case, if a position to be cut of the photographic paper 2 is shifted forward from the rear edge 6*a* of the screen 6 on the rear individual photographic paper 4*b*, a part of the screen protective layer 5 remains on a the rearward photographic paper 2. Under this state, it is difficult to form a rearward screen 6 adjacent to the screen 6 on the photographic paper 2.

On the other hand, according to the present invention, the individual photographic papers 4*a* and 4*b* are firstly formed by cutting the photographic paper 2. Following thereto, the screen protective layers 5 are formed on the overall surfaces of the individual photographic papers 4*a* and 4*b*. Thus, there is no possibility that a part of the screen protective layer 5 remains on the rearward photographic paper 2. Thus, instead of forming the screen protective layer 5 with a predetermined margin that is left from the rear edge 6*a* of the screen 6 on the rearward individual photographic paper 4*b*, the screen protective layer 5 can be formed on the overall surface of the screen 6 on the individual photographic layer 4*b*. As a result, there is no possibility that a part of the screen 6 might be exposed to the outside, whereby a light resistance of the screen 6 can be reliably retained, which results in maintaining an image quality of the screen 6.

According to this embodiment, it is possible to simultaneously perform the sublimation transfer of the Y colorant, the M colorant, and the C colorant by the first thermal head 10, and the thermal transfer of the screen protective layer 5 by the second thermal head 20. Thus, a time required for forming the screens 6 on the photographic paper 2 and forming the screen protective layers 5 on the overall surfaces of the screens 6 can be further reduced. Namely, a rate controlling of the thermal transfer printing method can be accelerated as a whole.

In addition, according to this embodiment, it takes relatively a longer period of time for the screen protective films 25 to be thermally transferred onto the overall surfaces of the screens 6 formed on the respective individual photographic papers 4*a* and 4*b* by the second thermal head 20, while the Y colorant, the M colorant, and the C colorant are being transferred onto the photographic paper 2 by sublimation by means of the first thermal head 10. Namely, the screen protective film 25 is reliably heated by the second thermal head 20 for relatively a longer period of time so as to be thermally transferred onto the overall surface of the screen 6. Thus, the screen protective layers 5 of a high quality can be formed on the overall surfaces of the screens 6 formed on the respective individual photographic papers 4*a* and 4*b*.

Further, as described above, when the screens 6 are formed by transferring the Y colorant, the M colorant, and the C colorant by sublimation, the photographic paper 2 is moved forward and rearward in order for the sublimation transfer of the Y colorant, the M colorant, and the C colorant. On the other hand, when the screen protective layer 5 is formed on the overall surface of the screen 6, each of the individual photographic papers 4*a* and 4*b* is not moved rearward. Suppose that the photographic paper 2 on which the screens 6 have been formed by the first thermal head 10 is sent to the second thermal head 20, without cutting the photographic paper 2, so as to form the screen protective layers 5. In this case, because of the difference in movement of the photographic paper 2 relative to the respective thermal heads, there is a possibility that the photographic paper 2 might be distorted and/or strained between the first thermal head 10 and the second thermal head 20, resulting in deterioration of a quality of the screens 6 formed on the photographic paper 2.

On the other hand, according to this embodiment, after the screens 6 have been formed on the photographic paper 2 by the first thermal head 10, the individual photographic papers 4*a* and 4*b* are manufactured by cutting the photographic paper 2 by the cutting means 19, and then the individual photographic papers 4*a* and 4*b* are sent to the second thermal head 20. Thus, there is no possibility that the photographic paper 2 is distorted and/or strained between the first thermal head 10 and the second thermal head 20. Therefore, a quality of the screens 6 formed on the photographic paper 2 can be reliably retained.

In this embodiment, when each of the screens 6 is formed on the photographic paper 2 by the first thermal head 10, the image of the screen 6 formed on the photographic paper 2 is gradually thinned from a part near to the rear edge 6*a* of the screen 6 toward the rear edge 6*a* of the screen 6. However, not limited to the rear edge 6*a* of the screen 6, the image of the screen 6 formed on the photographic paper 2 may be gradually thinned from parts near to peripheral edges of the screen 6 toward the respective peripheral edges of the screen 6.

In this embodiment, the two screens 6 each having an image are continuously formed on the photographic paper 2 by the first thermal head 10. However, the number of the screens 6 continuously formed on the photographic paper 2 is not limited to two, and three or more screens 6 may be formed. In this case, the photographic paper 2 is cut for each screen 6 by the cutting means 19, so that three or more individual photographic papers each having the one screen 6 are manufactured.

Third Embodiment

Next, a third embodiment of the thermal transfer printing method according to the present invention will be described with reference to FIGS. 7 and 8.

Figure 7:
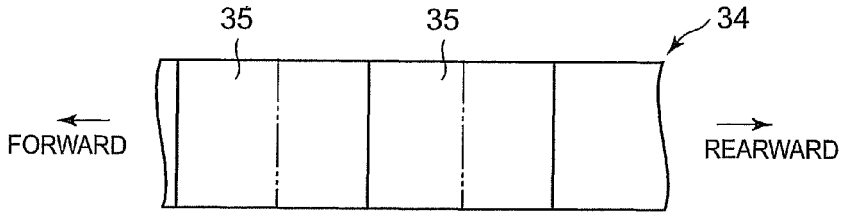
FIG. 7 is a top view of a screen protective ribbon used in a third embodiment of the thermal transfer printing method according to the present invention.
Figure 8:
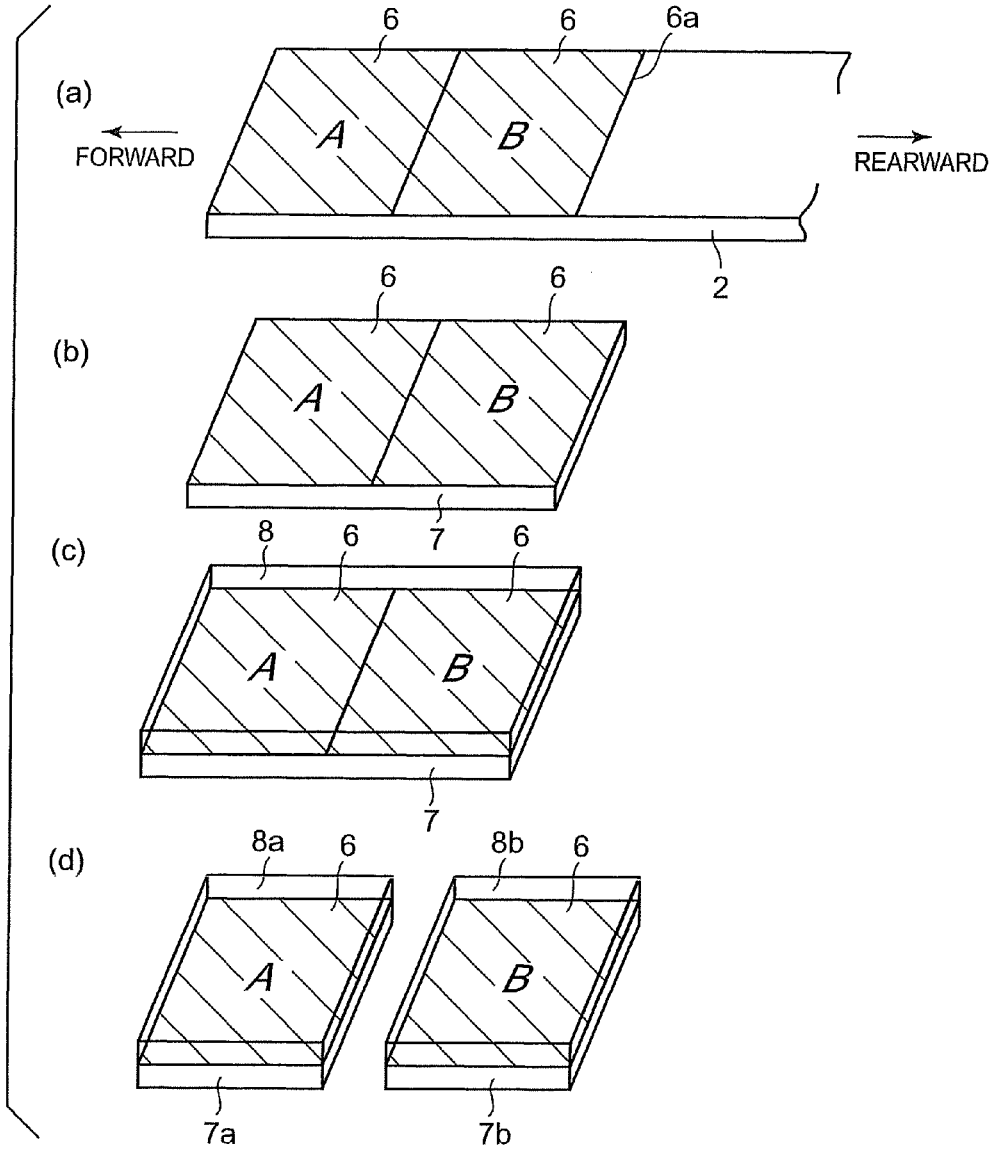
FIG. 8(*a*) is a view showing a state in which two screens each having an image are formed on a photographic paper in the third embodiment of the thermal transfer printing method according to the present invention.
Figure 9:
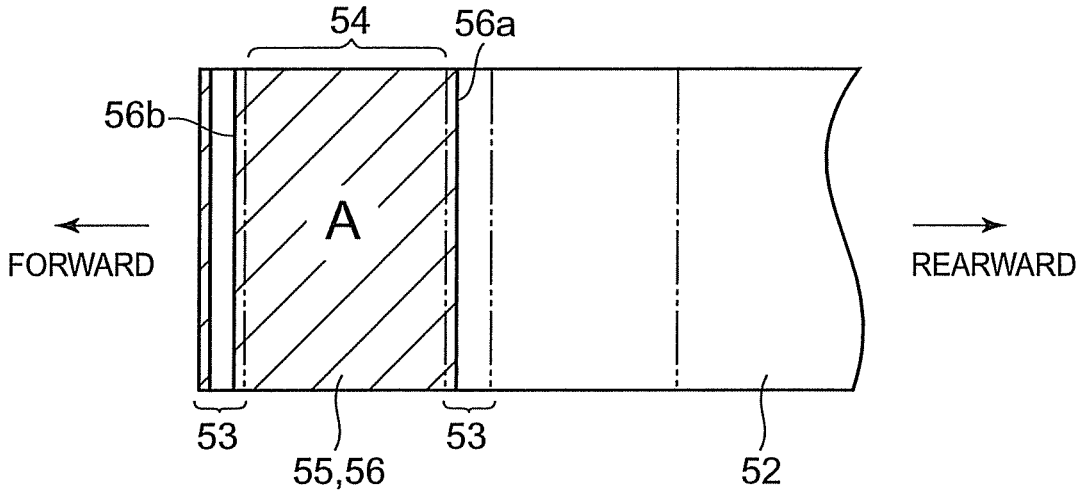
FIG. 9 is a top view showing a screen on a photographic paper formed by a conventional thermal transfer printing system.
Figure 10:
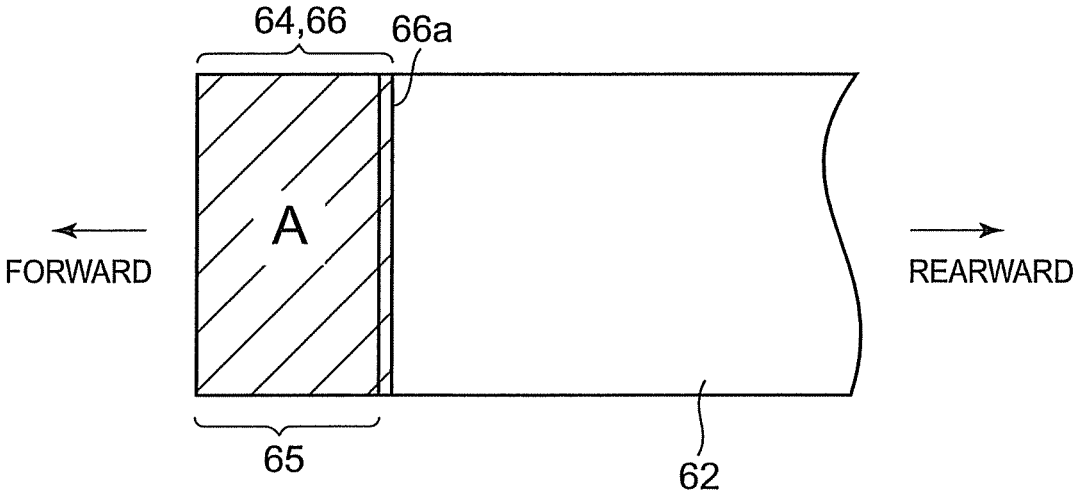
FIG. 10 is a top view showing a screen on a photographic paper formed by another conventional thermal transfer printing system.
Figure 11:
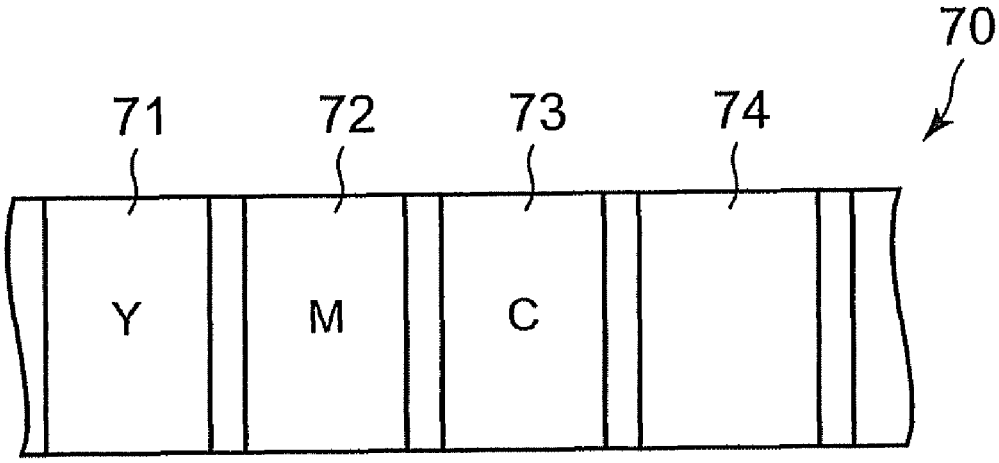
FIG. 11 is a top view showing a conventional ink ribbon.

The third embodiment of the thermal transfer printing method shown in FIGS. 7 and 8 differs from the second embodiment shown in FIGS. 5 and 6 only in that a photographic paper is cut by a cutting means at every two screens so that a multiple screen photographic paper is manufactured. Other structures of the third embodiment are substantially the same as those of the second embodiment. In FIGS. 7 and 8, the same elements as those in the second embodiment shown in FIGS. 5 and 6 are shown by the same reference numbers, and detailed description thereof is omitted.

As shown in FIG. 8(*a*), two screens 6 each having an image are continuously formed on a photographic paper 2. Then, as shown in FIG. 8(*b*), with the use of a cutting means 19 (see, FIG. 1), the photographic paper 2 is cut at every two screens each having an image, i.e., at a rear edge 6*a* of the rearward screen 6 of the two screens 6. Thus, a multiple screen photographic paper 7 composed of the two screens 6 each having an image is manufactured. Then, the multiple screen photographic paper 7 is placed on a conveyor 26*a* of a conveying means 26. Then, the conveyor 26*a* is driven by a driving part 26*b* of the conveying means 26, so that the multiple screen photographic paper 7 is conveyed to a position below a second thermal head 20 (see, FIG. 1). During this operation, as shown in FIG. 1, a screen protective ribbon 34 (see, FIG. 7) wound on a screen-protective-ribbon supply roll 21 is unwound therefrom, and the screen protective ribbon 24 is sent to the second thermal head 20. As shown in FIG. 7, a plurality of screen protective films 35 are formed on one surface of the screen protective ribbon 34. Each of the screen protective film 35 has dimensions corresponding to those of two screens 6 each having an image.

Then, as shown in FIG. 8(*c*), with the use of the screen protective ribbon 34, the screen protective film 35 is thermally transferred onto overall surfaces of the two screens 6 on the multiple screen photographic paper 7, so that a screen protective layer 8 is formed thereon. In this case, the multiple screen photographic paper 7 and the screen protective film 35 of the screen protective ribbon 34 are arranged in position in the first place. Then, as shown in FIG. 1, the second thermal head 20 is moved downward toward a conveyor 26*a* of a conveying means 26 by a second elevating means 23 connected to the second thermal head 20, so that the second thermal head 20 is brought into contact with the conveyor 26*a* of the conveying means 26 through the multiple screen photographic paper 7 and the screen protective ribbon 34.

Then, the conveyor 26*a* is driven by the driving part 26*b* of the conveying means 26, so that the multiple screen photographic paper 7 and the screen protective ribbon 34 on the conveyor 26*a* are sent forward. During this operation, the screen protective ribbon 34 is heated by the second thermal head 20, so that the screen protective film 35 is thermally transferred from the screen protective ribbon 34 onto the overall surfaces of the two screens 6 formed on the multiple screen photographic paper 7. At this time, the multiple screen photographic paper 7 is sent forward by a distance corresponding to the two screens 6 formed on the multiple screen photographic paper 7, and the screen protective ribbon 34 is sent forward (to the side of a screen-protective-ribbon withdrawal roll 22) by a distance corresponding to the two screens 6.

Then, the second thermal head 20 is moved upward by the second elevating means 23 so as to be away from the conveyor 26*a* of the conveying means 26. In this manner, the screen protective layer 8 is formed on the overall surfaces of the two screens 6 formed on the multiple screen photographic paper 7 (see, FIG. 8(*c*)).

Then, with the use of a second cutting means (not shown), the multiple screen photographic paper 7 on which the two screens 6 have been formed is cut for each screen 6, so that there are manufactured individual photographic papers 7*a* and 7*b* on which screen protective layers 8*a* and 8*b* are respectively formed on the respective screens 6 (see, FIG. 8(*d*)).

According to this embodiment, it takes relatively a longer period of time for the screen protective film 35 to be thermally transferred all at once onto the overall surfaces of the screens 6 formed on the multiple screen photographic paper 7 by means of the second thermal head 20, while the Y colorant, the M colorant, and the C colorant are being transferred by the first thermal head 10 onto the photographic paper 2 by sublimation. Namely, the screen protective film 35 is reliably heated by the second thermal head 20 for a longer period of time so as to be thermally transferred onto the overall surfaces of the two screens 6 formed on the multiple screen photographic paper 7. Thus, the screen protective layer 8 of a high quality can be formed on the overall surfaces of the two screens 6 formed on the multiple screen photographic papers 7.

The invention claimed is:

1. A thermal transfer printing method comprising:

a step in which a photographic paper is unwound from a photographic paper roll and the photographic paper is sent;

a step in which, with the use of an ink ribbon having a yellow layer, a magenta layer, and a cyan layer, a screen having an image is formed on the photographic paper, by transferring a yellow colorant, a magenta colorant, and a cyan colorant onto the photographic paper by sublimation by means of a first heating means, without providing a margin between the screen and a screen adjacent thereto, wherein when the screen is formed on the photographic paper by the first heating means, the image of the screen formed on the photographic paper is gradually thinned from at least a part near a rear edge of the screen towards at least the rear edge of the screen;

a step in which, after the screen has been formed on the photographic paper, the photographic paper is cut by means of a cutting means at the rear edge of the screen so as to manufacture an individual photographic paper on which the screen has been formed, and the individual photographic paper is conveyed to a second heating means; and a step in which, with the use of a screen protective ribbon having a screen protective film, a screen protective layer is formed on an overall surface of the screen formed on the individual photographic paper, by thermally transferring the screen protective film onto the overall surface of the screen formed on the individual photographic paper by means of the second heating means.

2. The thermal transfer printing method according to claim 1, wherein when the screen is formed on the photographic paper by the first heating means, an amount of each of the Y colorant, the magenta colorant, and the cyan colorant is gradually decreased from at least a part near the rear edge of the screen towards at least the rear edge of the screen, so as to gradually thin the image of the screen formed on the photographic paper.

3. The thermal transfer printing method according to claim 1, wherein when the screen is formed on the photographic paper by the first heating means, an amount of energy for heating each of the yellow layer, the magenta layer, and the cyan layer, by the first heating means is gradually decreased from at least a part near the rear edge of the screen towards at least the rear edge of the screen, so as to gradually thin the image of the screen formed on the photographic paper.

4. A thermal transfer printing method comprising:

a step in which a photographic paper is unwound from a photographic paper roll and the photographic paper is sent;

a step in which, with the use of an ink ribbon having a yellow layer, a magenta layer, and a cyan layer, with the yellow layer, the magenta layer and the cyan layer each having dimensions corresponding to a plurality of screens and with each screen having an image, whereby the plurality of screens are continuously formed on the photographic paper, by transferring a yellow colorant of said dimensions, a magenta colorant of said dimensions, and then a cyan colorant of said dimensions onto the photographic paper by sublimation by means of a first heating means;

a step in which, after the plurality of screens have been continuously formed on the photographic paper, the photographic paper is cut by means of a cutting means so as to manufacture individual photographic papers, with each photographic paper having an individual image and whereby the individual photographic papers are conveyed to a second heating means; and a step in which, with the use of a screen protective ribbon having screen protective films, screen protective layers are formed on surfaces of the screens formed on the individual photographic papers, by thermally transferring the screen protective films onto the surfaces of the screens formed on the individual photographic papers by means of the second heating means.

5. The thermal transfer printing method according to claim 4, wherein the cutting means cuts the photographic paper at each screen, so as to form the individual photographic papers.

* * * * *